United States Patent [19]

Moore

[11] 4,332,113

[45] Jun. 1, 1982

[54] VIDEO ROOM

[76] Inventor: Leslie T. Moore, 22749 Happy Hollow Rd., Diamond Bar, Calif. 91765

[21] Appl. No.: 126,038

[22] Filed: Feb. 29, 1980

[51] Int. Cl.[3] ..... E04H 3/22

[52] U.S. Cl. ..... 52/6; 52/73; 52/79.4

[58] Field of Search ..... 52/6, 73, 79.7, 79.4; 358/305

[56] References Cited

U.S. PATENT DOCUMENTS

| | | | |
|---|---|---|---|
| 2,308,169 | 1/1943 | Grace | 52/73 |
| 2,477,923 | 8/1949 | Fitt | 358/305 |
| 2,847,722 | 8/1958 | Wedeking | 52/6 |
| 2,927,351 | 3/1960 | Corso | 52/6 |
| 3,300,916 | 1/1967 | Brasch | 52/79.7 |
| 3,566,554 | 3/1971 | Schaffer et al. | 52/73 |
| 3,792,558 | 2/1974 | Berce et al. | 52/79.7 |
| 4,227,047 | 10/1980 | Horne | 52/6 |

*Primary Examiner*—Alfred C. Perham
*Attorney, Agent, or Firm*—Robert K. Wallor

[57] ABSTRACT

The art of building construction, and more particularly with the design and implementation of a specialized room addition to a typical single family residence wherein the addition contains not only the room construction, but also a suite of entertainment systems integrally constructed therein. The primary system included is a large screen projection television and its associated audio systems. Ancillary entertainment systems are included, as desired by the consumer.

4 Claims, 7 Drawing Figures

VIDEO ROOM

BACKGROUND OF THE INVENTION

While building construction, as an art, has been well developed through the literature and in practice, specialized constructions continue to be developed. In the present invention, standard building construction techniques are blended with modern entertainment technologies to produce an integrated entertainment center.

Auditoria and the like have been classed in Class 52, Subclass 6, Auditorium Structures. Nothing in the recent art in this class-subclass appears in conflict with the present invention. The patents found in said class-subclass appear to be constrained to systems for the public display of motion pictures, television, or live presentations to the general public. Many are concerned with multiple auditoria, with central display or control facilities.

Class 52, subclass 194 was considered as an alternate source of prior art. No apparent conflicts were found among the sound chambers of said class. Class 272, Subclass 2, et seq., were also reviewed as containing amusement structures.

The present invention appears, from the preliminary search, to be one of first impression, in that no prior art was discovered that provides for a small entertainment center structural addition to residential structures. The further incorporation of a suite of entertainment systems integrally designed into said structure, provides additional novelty and usefulness, as will be more particularly described hereinbelow.

SUMMARY OF THE INVENTION

The present invention provides a housing structure to accommodate a suite of audio and visual home entertainment devices. The structure is basically configured as rhomboidal prism, having two side walls, an end wall at the narrow end, and a planar roof sloped up from the narrow end. The fourth side is formed from the existing exterior wall of the residence to which this structure is added. The roof also attaches to the existing reference residential structure, the total forming a completely enclosed area. Access is provided from the existing residential structure by door means, directly into the addition. Additional ingress and egress may be provided to the exterior by one or more door means through the side walls of the addition.

In construction, the roof is supported by simple truss members placed generally parallel to the existing residential structure's exterior wall to which this addition is attached.

The internal construction of this structure includes acoustical materials on walls and ceiling such that the sound emanating from the several systems of the integrated entertainment suite are not distorted and are audible from each position within the room herein. Necessary electrical wiring is provided to power the several systems, room lights, and to conduct the sound from such systems to a series of speakers appropriately situated.

The integrated systems center about a large screen projection television system placed such that the viewing screen forms the major portion of the end wall at the narrow end of the structure. The wall areas to the right and left of said screen are occupied by the video system speaker, if such system is adapted to remote speakers. Space is also provided, in the form of shelves, for stereophonic sound systems, their speakers, indirect lighting, and for tapes and records for such systems. The end wall area below the viewing screen is adapted for incorporation of a video recorder system.

The remaining walls of the video room addition may be configured to the consumers taste to provide for bookcases and the like, which features are not part of this invention.

The constraints on the shape of the rhomboidal base area of the herein video room arise from the maximum angle of spectator viewing capability of present projection television systems.

The principal embodiment envisioned herein consists of the room addition and integrated projection television system, together with capability for the installation of the other mentioned systems.

DETAILED DESCRIPTION OF THE INVENTION

Figure 1:
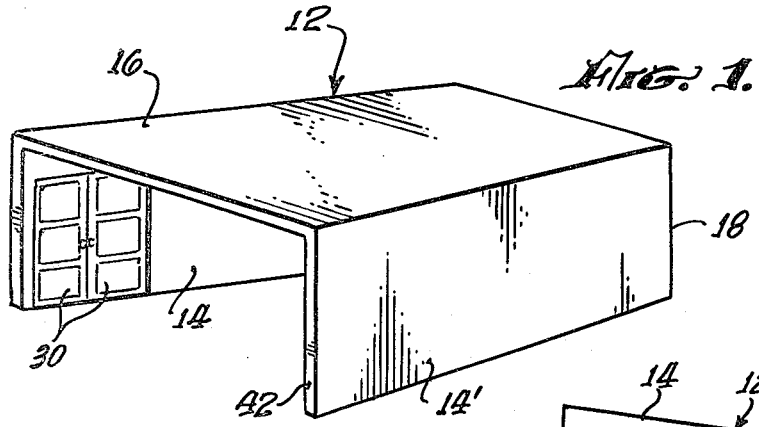
FIG. 1 is a perspective of the exterior of the video room, with a portion of the interior visible through the absent wall.

Referring now to the drawings, wherein like reference characters designate like or corresponding parts of the several figures, the preferred embodiment and its variations shall be described. It is to be noted that specific details shown in the several figures are representative and may have differing proportions dependent upon building codes in effect at the several sites of construction of this invention.

Referring now to FIG. 1, the video room addition 12 is shown as detached from the exterior of an existing residential structure. Having placed an appropriate footing and floor slab or structure, according to the appropriate building codes applicable to the situs of the construction of the present invention, the said video room 12 is configured thereon to have two vertically oriented side walls 14, 14', a roof structure 16, and an end wall 18. Ingress and egress may be provided by door means 30, as well as through a door or portal fabricated into the exterior wall of the referenced existing residential structure. The plane formed by the ends of the walls 14, 14' and the roof structure 16, identified in FIG. 1 as the end surface 42, forms the surface of attachment of the video room 12 to the referenced existing residence structure.

Figure 2:
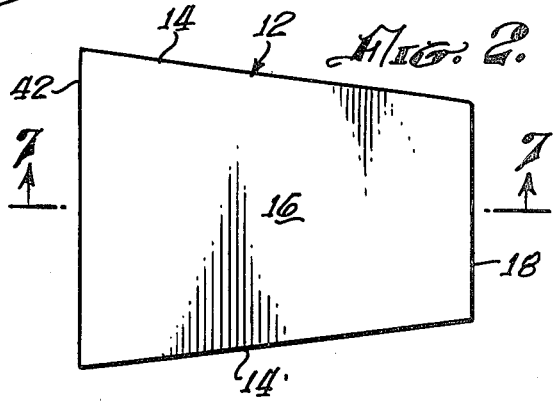
FIG. 2 is a plan view illustrating the shape of the video room.

Referring now to FIG. 2, the roof area 16 of the video room 12 is shown, in plan view, to be configured as a rhombus, such that the two side walls 14, 14' converge in separation from the house attachment surface 42 to the end wall 18. The roof 16 is of a generally planar structure and is supported by truss members spanning between the side walls 14, 14' and supported thereby.

Figure 3:
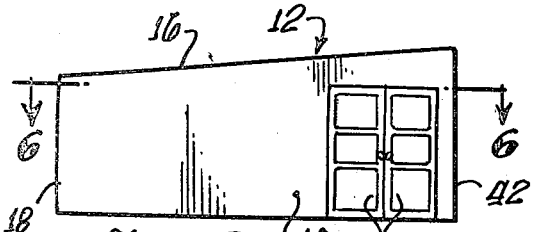
FIG. 3 is an exterior side elevation of the video room.

Referring now to FIG. 3, an exterior elevation view of wall 14, it is noted that the height of the wall decreases from the end bearing the house attachment surface 42 to the end wall 18, thereby providing that the roof structure 16 shall slope away from the referenced existing residence structure. The elevation of the side walls 14, 14', at the surface of attachment 42 is constrained to that available from the design of the referenced house 40, to include eaves and facia. At the outer end of said side walls 14, 14', at their juncture with the end wall 18, their elevation shall be not less than seven feet to accommodate the internal systems placement, and a standing person of reasonable height.

Figure 5:
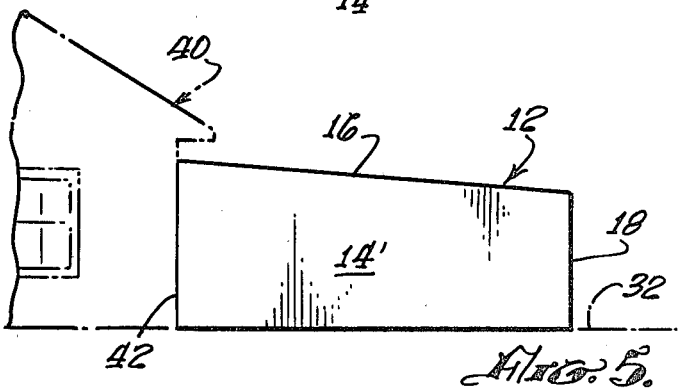
FIG. 5 is an exterior side elevation, illustrating one mode of attachment to a reference residence.

FIG. 5, illustrating the exterior elevation view of wall 14', likewise illustrates the roof slope feature and, further, provides a ghost partial illustration of the referenced existing residence structure 40, thereby defining the surface of attachment 42. It further shows the floor surface or slab 32 for reference purposes.

Figure 4:
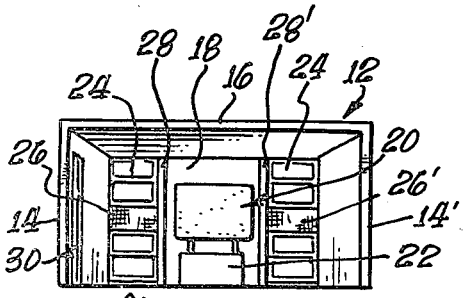
FIG. 4 is an end elevation, showing the interior of the video room, as taken from its plane of attachment to the reference residence.

Referring now to FIG. 4, the interior view of the video room 12 shows that the end wall 18 is of a generally rectangular shape and is of sufficient width to accommodate the interior systems areas and the projection screen 20. Said screen 20 is located central to said wall 18. Said screen 20, in general, has curvature approaching that of the central region of a large parabolic surface. Current models envisioned for inclusion utilize screens having a diagonal dimension in excess of 72 inches.

Also situated along said back wall 18, are a series of shelves 24, 24', which are utilized for speakers 26, 26', stereo sound systems, indirect lighting, light displays, and book, tape and record storage.

The projector 22 for the projection television system may be placed appropriately within the room area, as constrained by the projection system incorporated.

The interior of the side walls 14, 14' and the roof 16 are treated with appropriate acoustical materials to provide high sound qualities throughout the room. Specific details are not herein provided since such design is beyond the scope of this invention and such techniques are well known.

Figure 6:
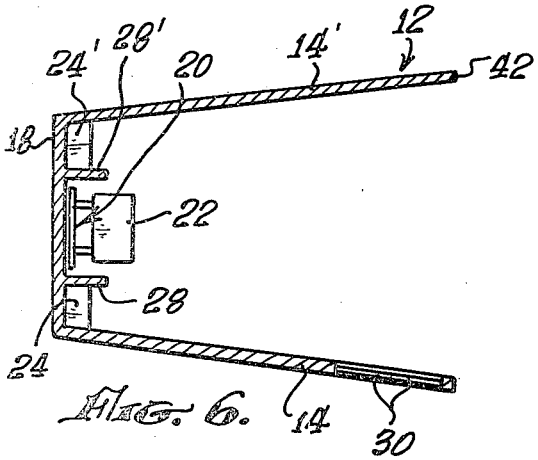
FIG. 6 is a sectional plan view of the interior of the video room, taken from 6—6 of FIG. 3.
Figure 7:
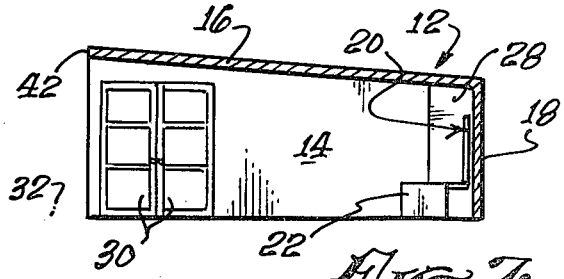
FIG. 7 is an interior elevation view of the video room, taken from 7—7 of FIG. 2.

Referring now to FIGS. 6 and 7, it is shown that the sides 28, 28' of the shelf structures 24, 24' form a central alcove area along the end wall 18, into which is placed the viewing screen 20. The orientations of the side walls 14, 14' relative to the normals to the exterior of the referenced house at the surface of attachment 42 are such that the interior lines of sight from points near the interior surfaces of said walls 14, 14' to the viewing screen 20 do not exceed the angular viewing capability of television projection systems, typically 30 to 35 degrees total included angle.

All construction throughout the walls 14, 14', and 18, and the roof 16 shall be adapted to the requirements of the building codes of the situs of the construction of this video room 12, however, such variations shall not influence the general shape of the video room nor the nature of the incorporated systems.

Fixed seating facilities are not provided, since each user will have his or her preferred arrangement.

Additional speakers, connected to the several systems by wiring within the walls, may be strategically placed throughout the video room.

A retractable motion picture screen may be hung from the ceiling or incorporated within the roof construction for additional entertainment capability.

Although the invention has been herein shown and described in what are conceived to be the most practical and preferred embodiments, it is recognized that departures may be made therefrom within the scope of the invention, which is therefore not to be limited to the illustrative details disclosed.

Having described my invention, I claim:

1. A video room addition structure comprising two vertically oriented side walls each tapering in elevation correspondingly, and placed such that they approach each other in horizontal separation as their elevation decreases; an end wall, of rectangular shape, vertically oriented, enclosing the narrow, lowest elevation ends of the said side walls, and rigidly affixed to each of said side walls; a planar roof, supported by trusses spanning the area between the side walls; and an integrally combined large screen projection television system, such that the components thereof are built into the structure, with the viewing screen placed as part of the interior of the said end wall; the entire structure being constructed in place and rigidly affixed to an existing residential structure, with appropriate ingress and egress, and utilities interconnections provided as necessary.

2. The video room addition structure, of claim 1, wherein the interior construction of the said end wall includes a series of shelves to either side of said video projection screen.

3. The video room addition structure of claim 2, wherein the said shelves are utilized to support a stereophonic or quadrophonic sound system, integrally wired through the room addition structure to remote speaker locations.

4. The video room addition of claim 1, wherein the retractable motion picture screen is constructed within the roof structure near the end wall of said room addition, such that it may be viewed from the balance of the said room, when deployed; and such that it may be deployed or retracted by electromechanical means integrally constructed into such video room addition.

* * * * *